United States Patent [19]

Meagher

[11] Patent Number: 5,062,580

[45] Date of Patent: Nov. 5, 1991

[54] SPOOL WITH RESILIENT TAB FOR STORING AND DISPENSING FILAMENTARY MATERIAL

[75] Inventor: Brian R. Meagher, Bloomington, Minn.

[73] Assignee: Katun Corporation, Minneapolis, Minn.

[21] Appl. No.: 662,229

[22] Filed: Feb. 28, 1991

[51] Int. Cl.[5] ..... B65H 75/28

[52] U.S. Cl. ..... 242/125.2; 242/118.4; 242/138

[58] Field of Search ..... 242/125.2, 125.3, 125, 242/125.1, 137, 138, 118.4

[56] References Cited

U.S. PATENT DOCUMENTS

| | | | |
|---|---|---|---|
| 766,936 | 8/1904 | De Roseau . | |
| 1,029,518 | 6/1912 | Temple . | |
| 1,606,563 | 11/1926 | Deane . | |
| 1,851,314 | 3/1932 | Knoche | 242/125.2 X |
| 1,859,842 | 5/1932 | Radford | 242/125.2 |
| 1,916,712 | 7/1933 | Atwood . | |
| 1,985,742 | 12/1934 | Rea | 242/118.4 |
| 2,465,573 | 3/1949 | Brannon | 242/118.4 |
| 2,776,097 | 1/1957 | Bruestle | 242/125 |
| 3,278,017 | 10/1966 | Kearns | 206/52 |
| 3,278,136 | 10/1966 | Rosen | 242/138 |
| 3,308,937 | 3/1967 | Rosen | 206/52 |
| 3,452,879 | 7/1969 | Guarino | 211/71 |
| 3,810,588 | 5/1974 | Mahoney | 242/55 |
| 4,591,110 | 5/1986 | Wirts et al. | 242/129 |
| 4,634,076 | 1/1987 | Eckert et al. | 242/118 |
| 4,842,212 | 6/1989 | Loiselle et al. | 242/96 |

FOREIGN PATENT DOCUMENTS

| | | | |
|---|---|---|---|
| 1574125 | 9/1980 | United Kingdom | 242/138 |

*Primary Examiner*—Stanley N. Gilreath
*Attorney, Agent, or Firm*—Kinney & Lange

[57] ABSTRACT

A spool stores and dispenses filamentary material. The spool includes a back plate, a front plate and an outer hub around which the filamentary material is wound. The outer hub connects the back plate to the front plate. The back plate includes a pocket which extends inward from an outer edge. Securely positioned in the pocket is a resilient tab deflectable from a locked position into a released position and tending to return to the locked position, for capturing a loose end of the filamentary material between the resilient tab and the back plate in the locked position and for releasing the loose end in the released position.

14 Claims, 2 Drawing Sheets

SPOOL WITH RESILIENT TAB FOR STORING AND DISPENSING FILAMENTARY MATERIAL

BACKGROUND OF THE INVENTION

This invention relates to a spool for storing and dispensing filamentary material such as corona wire for a photocopy machine. More specifically, the present invention relates to a spool having a resilient tab for capturing a loose end of the filamentary material.

Spools have long been employed for loading, storing and dispensing thread, yarn, wire and other filamentary material. Some spools have incorporated a retainment feature to capture the loose end of the filamentary material. For example, Bruestle U.S. Pat. No. 2,776,097 discloses a cutting and clamping mechanism which consists of a movable plate slidably mounted in a guideway formed in a disc-like spool head. The cutting and clamping mechanism is urged radially outward from the spool head by the centrifugal force generated by the spinning spool. As the spinning spool is loaded with wire and becomes full, the wire is crossed over to a spinning empty spool. The wire is cut and clamped by the extended cutting and clamping head. As the spool comes to a stop, the centrifugal force generated by the spinning spool is overcome by the centripetal force supplied by a spring. The cutting and clamping head retracts radially inward and retains the wire temporarily until it can be retained by more suitable means.

Deroseau U.S. Pat. No. 766,936 discloses a spool with a retainment feature for storing and dispensing chalk line. The spool includes a drum having laterally extending end flanges with a traverse recess in one of the flanges. The retainment feature is implemented by employing two clamping plates, a first clamping plate attached securely to the flange that includes the traverse recess, and a second resilient plate, normally in contact with the first plate, connected to a spring loaded stud which extends through the traverse recess to a stop button located on the opposite side of the flange. The chalk line is clamped by depressing the stop button to separate the plates, positioning the chalk line between the plates, and releasing the stop button, thereby allowing the spring loaded stud to urge the second plate toward the first plate clamping the chalk line.

Other devices such as Mahoney U.S. Pat. No. 3,810,588 and Temple U.S. Pat. No. 1,029,518 employ protective covers or housings which include a retainment feature for capturing the loose end of a filamentary material. However, these inventions do not include the retainment feature in the spool itself.

These devices, however, are generally not suitable for storing and dispensing delicate filamentary material such as corona wire. Corona wire is used in plain paper copiers, laser printers and plain paper facsimile machines utilizing the basic xerographic process to distribute an electric charge onto various surfaces. Spools that have been used in the past for storing corona wire include a retainment feature which is either ineffective, or tends to kink or tangle the wire. If the corona wire becomes kinked or tangled, that segment of the corona wire must be discarded. The retainment feature has been implemented in various ways.

In one implementation, the wire is retained by forcing the wire into a slot in the side of the spool made of a soft plastic material. The wire is kinked at the point at which it is forced into the slot. In another implementation, an adhesive sticker is used to hold the loose end of the corona wire to the side of the spool. While this implementation does not produce a sharp kink in the wire, the application of the sticker to the side of the spool is awkward and may lead to the user tangling the wire. Also, the adhesive properties of the sticker decline with continued use. A third implementation of the retainment feature is to employ a cap which fits firmly within an inner hub of a spool to clamp the wire between an outer cap surface and an inner hub surface. This implementation produces two sharp kinks in the corona wire.

SUMMARY OF THE INVENTION

The present invention is a spool for storing and dispensing a filamentary material such as corona wire. The spool captures the loose end of the corona wire while minimizing kinking and tangling. By employing a resilient tab securely positioned in a pocket of a plate of the spool, the loose end of the corona wire can be captured by deflecting the resilient tab into a released position, placing the corona wire between the resilient tab and a plate surface, and releasing the resilient tab. The resilient tab tends to return to a locked position capturing the loose end of the corona wire between the resilient tab and the plate. In one embodiment, the corona wire spool also includes a protective cover to keep the corona wire free from contaminants. In another embodiment, the spool includes an outer hub that has a relatively large diameter to reduce the number of times the corona wire wraps around the spool hub, thereby decreasing the potential for tangling.

DETAILED DESCRIPTION OF THE PREFERRED EMBODIMENTS

The present invention is a spool with a protective cover for storing and dispensing a filamentary material such as corona wire. The spool includes a resilient tab positioned securely in a pocket in a side plate of the spool. The resilient tab is provided for capturing and releasing a loose end of the filamentary material.

Figure 1:
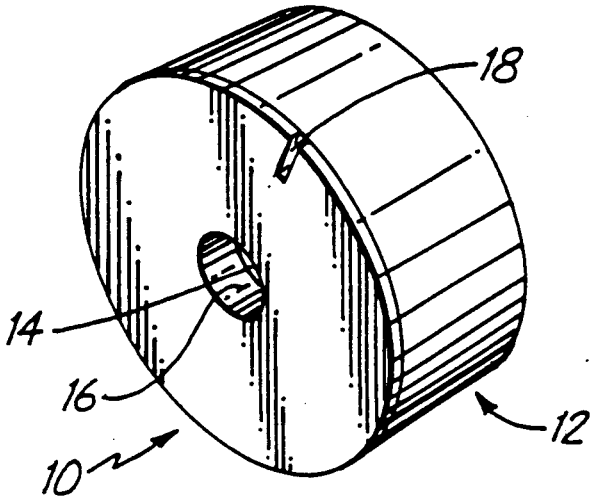
FIG. 1 is a perspective view of a spool with a protective cover, in accordance with the present invention.

FIG. 1 is a perspective view of spool 10 of the present invention with protective cover 12 firmly seated over spool 10. Cover 12 has a center post 14 which seats firmly within inner hub 16 of spool 10. Spool 10 also includes slot 18 which is used to retain the filamentary material as it is initially wound onto spool 10.

Figure 2:
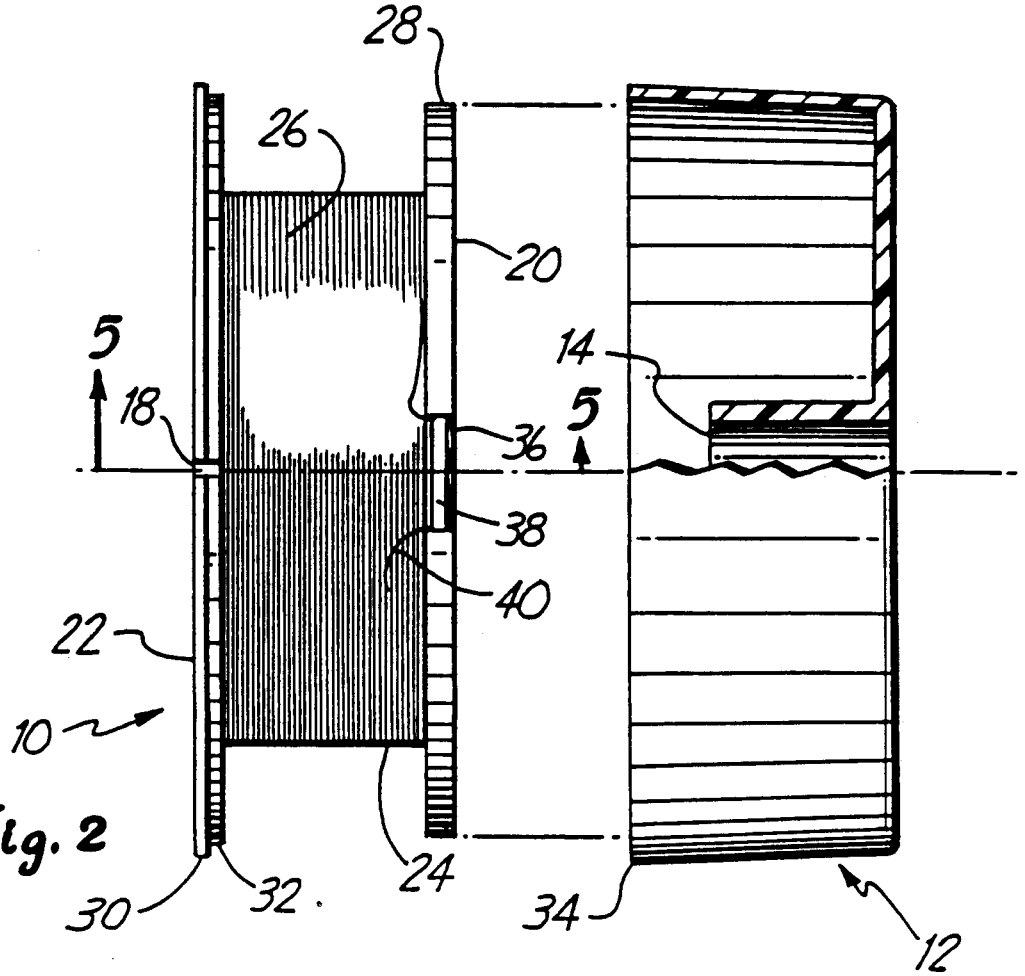
FIG. 2 is an end view of the spool shown in FIG. 1 with the protective cover removed, the spool has a resilient tab positioned in a pocket for capturing a loose end of a filamentary material.

FIG. 2 is an end view of spool 10 shown in FIG. 1 with protective cover 12 removed. Spool 10 includes back ring 20, front ring 22 and outer hub 24, around which filamentary material 26 is wound. Outer hub 24 is connected coaxially between back ring 20 and front ring 22. In one embodiment, back ring 20 and front ring 22 are replaced by plates, which may be of a variety of shapes and may include an aperture. In another embodiment, outer hub 24 has a relatively large diameter to reduce the possibility that filamentary material 26 may become tangled or kinked.

Back ring 20 has outer edge 28 that is smaller than outer edge 30 of front ring 22 so that back ring 20 fits within cover 12. Front ring 22 includes bevelled lip 32, which faces back ring 20. Bevelled lip 32 receives outer edge 34 of cover 12 when cover 12 is placed over spool 10. Cover !2 also includes center post 14 which seats firmly within inner hub 16 (shown in FIG. 1) when cover 12 is placed over spool 10.

Back ring 20 includes pocket 36 in which resilient tab 38 is securely positioned. Resilient tab 38 is provided for capturing a loose end 40 of filamentary material 26 between resilient tab 38 and back ring 20.

Figure 3:
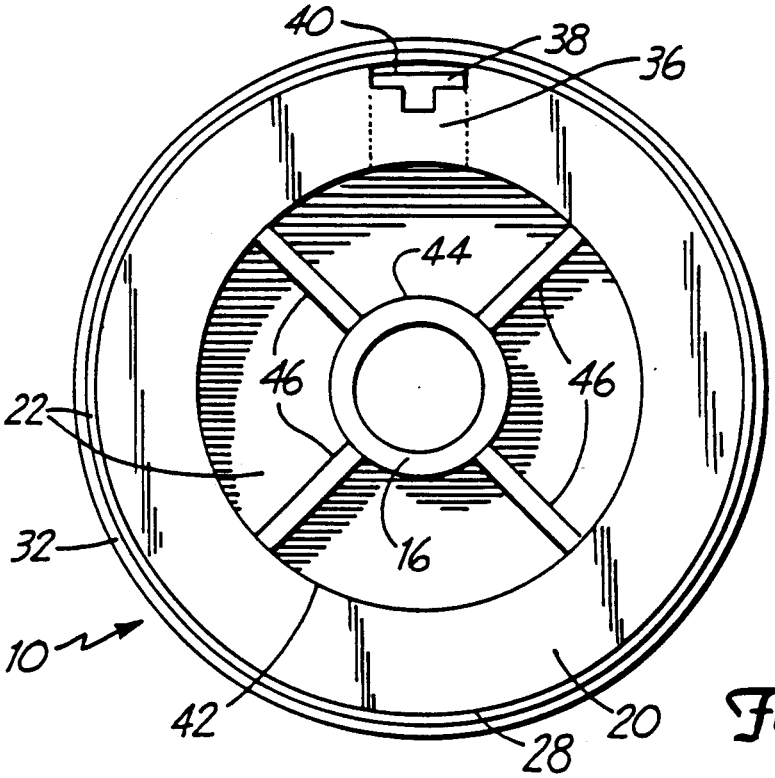
FIG. 3 is a side view of the spool shown in FIG. 2.

FIG. 3 is a side view of spool 10. Back ring 20 includes outer edge 28 and inner edge 42. Front ring 22, including bevelled lip 32, is visible beyond outer edge 28 of back ring 20, and within inner edge 42 of back ring 20. Outer hub 24 (shown in FIG. 2) is connected coaxially with inner edge 42 of back ring 20. Inner hub 16 is connected coaxially with inner edge 44 of front ring 22. A plurality of spokes 46 connect inner hub 16 to outer hub 24 (shown in FIG. 2). In one embodiment, back ring 20, front ring 22, outer hub 24, inner hub 16 and plurality of spokes 46 are formed integrally of plastic.

Pocket 36 is shown (in phantom) extending from outer edge 28 through to inner edge 42 of back ring 20. Positioned securely in pocket 36 is resilient tab 38, with loose end 40 of filamentary material 26 (shown in FIG. 2) captured between resilient tab 38 and back ring 20.

Figure 4:
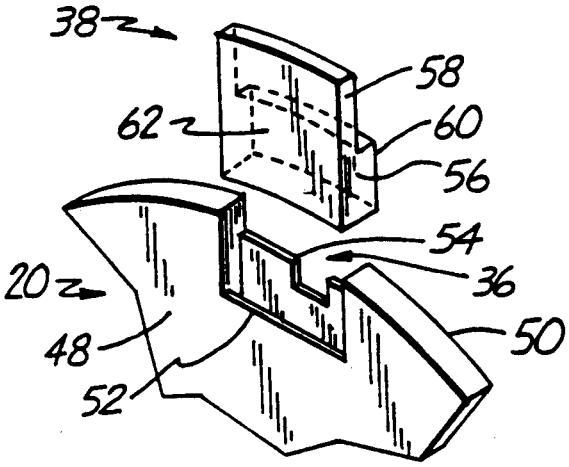
FIG. 4 is a perspective fragmentary view of the pocket and the resilient tab shown in FIG. 2, with the resilient tab removed and shown above the pocket.

FIG. 4 is a perspective fragmentary view of back ring 20 showing pocket 36 and resilient tab 38. Resilient tab 38 is removed and shown above pocket 36. Back ring 20 has inner side 48 and outer side 50. Inner side 48 faces front ring 22 (shown in FIG. 2). Pocket 36 has inner notch 52 located on inner side 48. Inner notch 52 facilitates deflection of resilient tab 38 past inner side 48 in preparation for capturing loose end 40 (shown in FIG. 2). Outer notch 54 is located on outer side 50. Outer notch 54 is provided to expose enough of resilient tab 38 to allow a user of spool 10 to apply a deflection force to resilient tab 38 in the direction of front ring 22 (shown in FIG. 2).

Resilient tab 38 includes a thick section 56 and a thin section 58. Thick section 56 facilitates secure and stable placement of resilient tab 38 in pocket 36. Thin section 58 extends radially outward beyond inner notch 52 and outer notch 54 of pocket 36 and increases the resiliency of resilient tab 38. Resilient tab 38 further includes stepped face 60 and flat face 62. Stepped face 60 includes a step which separates thin section 58 from thick section 56. Resilient tab 38 is positioned in pocket 36 with flat face 62 facing front ring 22 (shown in FIG. 2) and thick section 56 oriented radially inward with respect to thin section 58.

Figure 5:
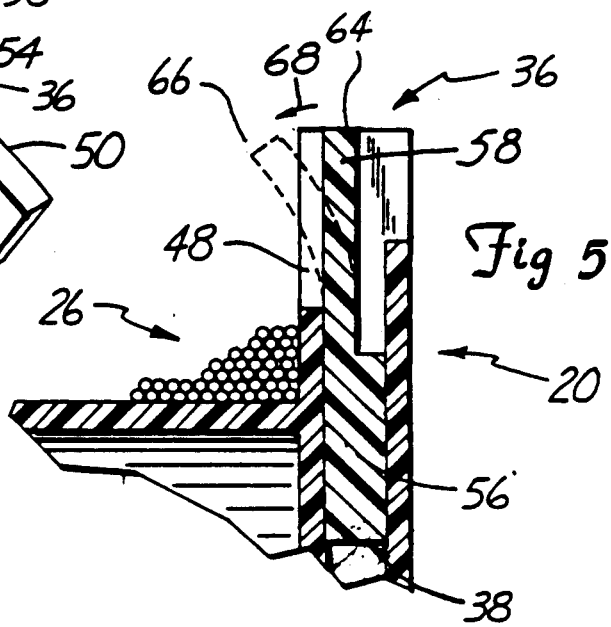
FIG. 5 is an enlarged fragmentary sectional view taken along line 5—5 of FIG. 2 showing the resilient tab positioned in the pocket of the spool.

FIG. 5 is an enlarged fragmentary sectional view of resilient tab 38 positioned in pocket 36 as seen from line 5—5 of FIG. 2. Resilient tab 38 is shown in locked position 64 and in released position 66 (shown in phantom). A user of spool 10 manipulates resilient tab 38 to either capture or release loose end 40 (shown in FIG. 2) of filamentary material 26. To position resilient tab 38 into released position 66, the user of spool 10 applies a deflection force on resilient tab 38 in the direction depicted by arrow 68 to deflect the tab past inner side 48. The user of spool 10 can now either release loose end 40 (shown in FIG. 2) if it was previously captured, or capture loose end 40 by positioning loose end 40 between deflected resilient tab 38 and inner side 48 and then removing the applied deflection force. When the applied deflection force is removed, resilient tab 38 tends to return to locked position 64, capturing loose end 40 between resilient tab 38 and back plate 20.

The present invention improves the storing and dispensing of filamentary material such as corona wire. The invention incorporates a simple and inexpensive retainment feature that is flush with the back ring of the spool, and minimizes kinking and tangling of the filamentary material. The spool is also provided with a protective cover to keep the corona wire free from contaminants, an important concern since the spool will typically be carried in a tool box with other supplies and tools.

Although the present invention has been described with reference to preferred embodiments, workers skilled in the art will recognize that changes may be made in form and detail without departing from the spirit and scope of the invention.

What is claimed is:

1. A spool for storing and dispensing a filamentary material, such as corona wire, the spool comprising:
   - a front ring;
   - a back ring having an outer edge and an inner surface facing the front ring;
   - a pocket extending radially inward from the outer edge and having an inner notch on the inner surface extending radially inward from the outer edge;
   - an outer hub around which the filamentary material is wound, connected coaxially between the back ring and the front ring; and
   - resilient tab means positioned securely within the pocket for capturing a loose end of the filamentary material between the resilient tab means and the back ring in a locked position and for releasing the loose en din a released position, the resilient tab means being deflectable from the locked position into the released position and tending to return to the locked position.

2. The spool of claim 1 and further comprising an inner hub positioned coaxially within the outer hub.

3. The spool of claim 2 and further comprising a plurality of spokes connecting the inner hub to the outer hub.

4. The spool of claim 3 wherein the back ring, the front ring, the outer hub, the inner hub and the spokes are formed integrally.

5. The spool of 1 wherein the resilient tab means has a thick section that is securely positioned in the pocket and a thin section that extends radially outward, to facilitate secure and stable placement of the thick section in the pocket and to increase resiliency of the resilient tab means.

6. The spool of claim 5 wherein the resilient tab means has a flat face and a stepped face, the stepped face having a step separating the thin section from the thick section and wherein the resilient tab means is positioned in the pocket with the flat face facing the front ring.

7. The spool of claim 1 wherein the back ring has an outer surface facing away from the front ring and wherein the pocket has an outer notch on the outer surface that extends radially inward from the outer edge of the back ring to facilitate application of a deflection force required to deflect the resilient tab means from the locked position into the released position.

8. The spool of claim 1 wherein the back ring, the front ring and the outer hub are formed integrally.

9. The spool of claim 1 and further comprising a spool cover that seats firmly over the spool.

10. A spool for storing and dispensing a filamentary material, such as corona wire, the spool comprising:

a back ring having an inner radius, an outer radius and a pocket which extends from the outer radius through to the inner radius, the pocket further having an outer notch and an inner notch that extend radially inward;

a front ring having an inner radius, an outer radius which is larger than the outer radius of the back ring, a bevelled lip along the outer radius and a slot extending radially inward from the outer radius for retaining the filamentary material as it is initially wound onto the spool; an outer hub around which the filamentary material is wound, connected coaxially between the inner radius of the back ring and the front ring, wherein the bevelled lip of the front ring faces the back ring and the inner notch of the pocket faces the front ring;

an inner hub connected coaxially with the inner radius of the front ring;

a plurality of spokes connecting the inner hub to the outer hub;

a resilient tab positioned securely within the pocket for capturing a loose end of the filamentary material between the resilient tab and the back ring in a locked position and for releasing the loose end in a released position; the resilient tab deflectable toward the front ring into the released position and tending to return to the locked position; and having a thick section positioned securely in the pocket and a thin section that extends radially outward beyond the inner notch and the outer notch; and having a flat face and a stepped face, the stepped face having a step separating the thin section from the thick section, the resilient tab positioned in the pocket with the flat face facing the front ring; and a spool cover having an open end that seats firmly into the bevelled lip of the front being and a post that seats firmly within the inner hub when the spool cover is placed over the spool.

11. The spool of claim 10 wherein the front ring, the back ring, the spokes, the inner hub and the outer hub are formed integrally.

12. A spool for storing and dispensing a filamentary material, such as corona wire, the spool comprising:

a back plate having an outer edge;

a pocket extending radially inward from the outer edge and having a notch extending radially inward from the outer edge;

a front plate;

an outer hub around which the filamentary material is wound, connected between the back plate and the front plate; and resilient tab means positioned securely within the pocket for capturing a loose end of the filamentary material between the resilient tab means and the back plate in a locked position and for releasing the loose end in a released position, the resilient tab means deflectable from the locked position into the released position and tending to return to the locked position.

13. The spool of claim 12 wherein the back plate and the front plate are circular.

14. The spool of claim 12 wherein the back plate and the front plate include an aperture.

* * * * *

UNITED STATES PATENT AND TRADEMARK OFFICE

CERTIFICATE OF CORRECTION

PATENT NO. : 5,062,580

DATED : November 5, 1991

INVENTOR(S) : Brian R. Meagher

It is certified that error appears in the above-identified patent and that said Letters Patent is hereby corrected as shown below:

Col. 4, line 40, delete "en din" and insert --end in--.

Col. 6, line 8, delete "being" and insert --ring--.

Signed and Sealed this

Ninth Day of March, 1993

*Attest:*

STEPHEN G. KUNIN

*Attesting Officer*

*Acting Commissioner of Patents and Trademarks*